US005901862A

United States Patent [19]

Riga et al.

[11] Patent Number: 5,901,862

[45] Date of Patent: May 11, 1999

[54] DEATH CARE MERCHANDISE DISPLAY UNIT

[75] Inventors: Dennis J. Riga, New Albany; Douglas E. Kellogg, Canal Winchester, both of Ohio

[73] Assignee: The York Group, Inc., Houston, Tex.

[21] Appl. No.: 08/788,324

[22] Filed: Jan. 24, 1997

[51] Int. Cl.[6] ..... A47F 7/00

[52] U.S. Cl. ..... 211/85.16

[58] Field of Search ..... 211/85.16, 27, 211/162; 27/1, 27; 52/128, 134, 129

[56] References Cited

U.S. PATENT DOCUMENTS

| | | | |
|---|---|---|---|
| D. 48,928 | 4/1916 | Clark . | |
| D. 218,890 | 10/1970 | Kreminski | D19/1 |
| D. 350,246 | 9/1994 | Louise et al. | D6/479 |
| D. 351,076 | 10/1994 | Eliadis et al. | D6/476 |
| D. 354,825 | 1/1995 | Parker | D99/8 |
| D. 381,693 | 7/1997 | Thompson | D20/10 |
| 518,335 | 4/1894 | Sherman . | |
| 1,134,719 | 4/1915 | Benzing . | |
| 1,821,760 | 9/1931 | Leitch et al. . | |
| 1,912,790 | 6/1933 | Payne . | |
| 1,966,751 | 7/1934 | Brefeld . | |
| 3,190,243 | 6/1965 | Pira | 108/152 |
| 3,504,409 | 4/1970 | Keller, Jr. | 27/6 |
| 3,567,039 | 3/1971 | Evans . | |
| 3,585,944 | 6/1971 | Schoer | 108/111 |
| 3,676,905 | 7/1972 | Mack | 27/6 |
| 4,891,897 | 1/1990 | Gieske et al. | 40/618 |
| 4,998,388 | 3/1991 | Englehart | 52/36 |
| 5,370,249 | 12/1994 | Harvey et al. | 211/189 |
| 5,405,017 | 4/1995 | Szabo, Sr. et al. . | |
| 5,495,954 | 3/1996 | Schmit | 211/90 |
| 5,524,394 | 6/1996 | Szabo, Sr. et al. . | |
| 5,586,376 | 12/1996 | Enneking et al. . | |
| 5,622,010 | 4/1997 | Weber | 52/36.4 |

*Primary Examiner*—Alvin Chin-Shue
*Assistant Examiner*—Sarah Purol
*Attorney, Agent, or Firm*—Locke Liddell & Sapp LLP

[57] ABSTRACT

A death care merchandise display unit comprises two vertical, parallel, spaced wing wall panels, a vertical back wall means having lateral edges secured to the rear edges of the wing wall panels and optionally at least one decedent confinement chamber positioned between the two vertical spaced wing wall panels with a drawer slide means for rolling the chamber outward or a cornice display structure projecting from the vertical back wall of the merchandise display area or securement means for affixing death care merchandise selected from coffins, caskets, vaults, urns, sectionals or miniatures thereof and materials for decorating the same onto the merchandise display area. The securement means may consist of drawers adjacent to the decedent confinement chamber for exhibiting casket adornment materials. The cornice display structure may consist of two vertical panels and a horizontal beam secured to the vertical panels, the horizontal beam extending at least fifty percent of the distance defined by the vertical back wall. In addition, the cornice display structure may contain an illumination means affixed onto its inner perimeter. The securement means may further comprise a means for downwardly extending at least one decedent confinement chamber from a vertical wing wall panel.

63 Claims, 14 Drawing Sheets

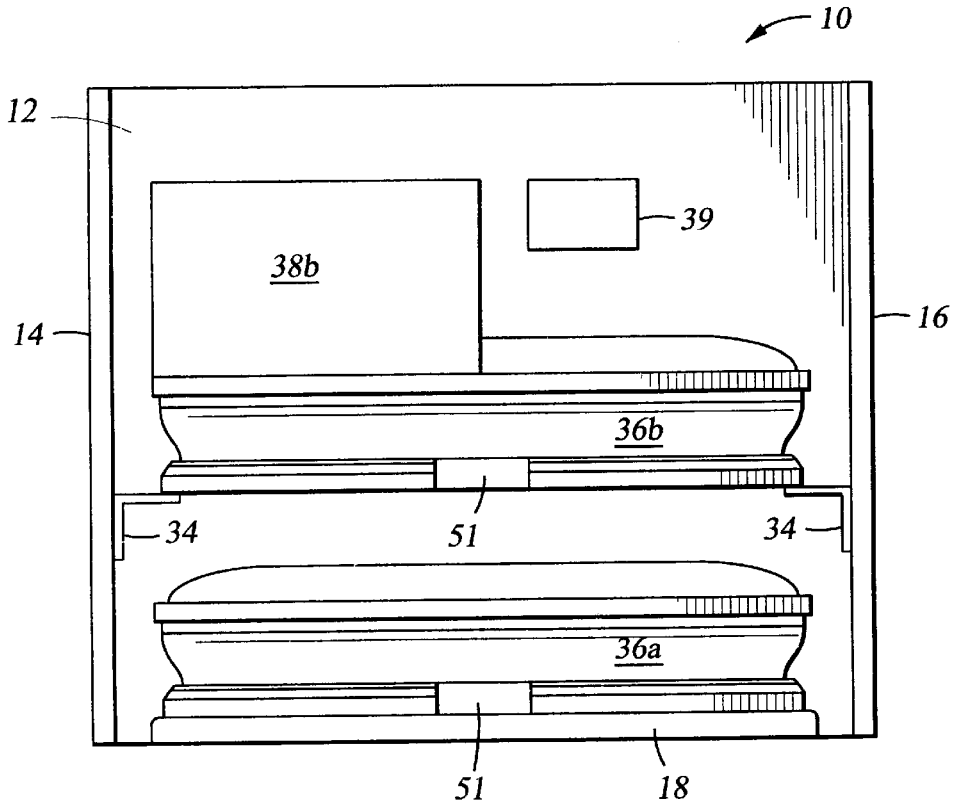
Fig. 1
Fig. 2
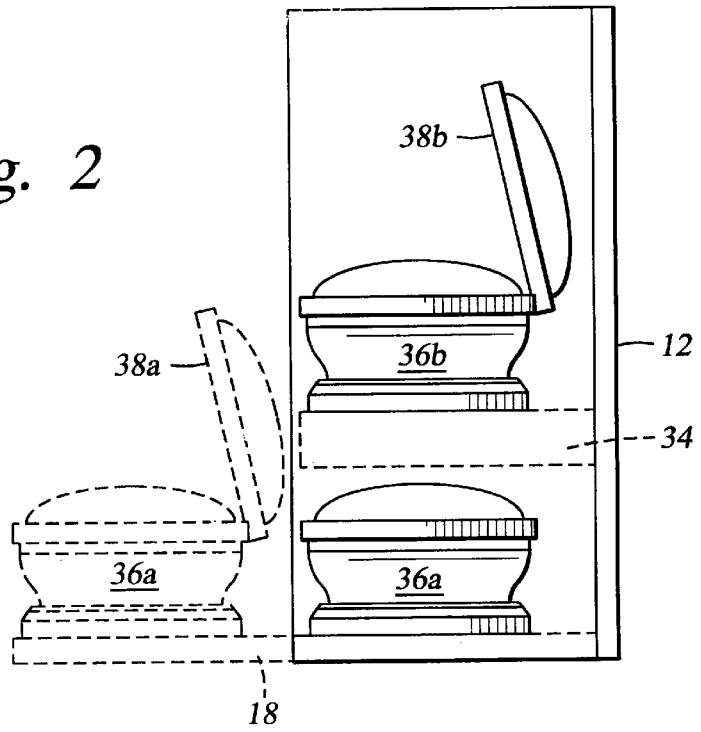

DEATH CARE MERCHANDISE DISPLAY UNIT

FIELD OF THE INVENTION

The present invention relates to an integrated display system for death care merchandise such as caskets, coffins, urns, burial vaults and materials for decorating or adorning the same. The display systems of the invention are particularly designed for use by prospective purchasers in a preview room. In addition, they may be useful for displaying death care merchandise during its intended use, such as in a memorial or funeral service as well as viewing room.

BACKGROUND OF THE INVENTION

Various casket display systems are known in the art. The more primitive of such systems consist of a casket display rack or support. See, for instance, U.S. Pat. No. 2,937,768 which discloses a two-tiered casket display rack having a rigid C-shaped frame-like structure for the display of two caskets—one casket supported above another.

U.S. Pat. No. 5,405,017 discloses a more contemporary casket display system for full caskets. The display system of the '017 patent includes a two-tiered casket display rack retractable by means of a scissors unit which, in turn, is connected to a rod. The display rack of the '017 patent is not an integral part of the casket display system.

While the casket display system of the '017 patent offers a more serene setting than the primitive systems of the prior art, as set forth in the '768 patent, they do not permit the full display of merchandise used in the funeral and death care industry. In addition, it does not permit the display of all types of merchandise such as adornment accessories, urns and burial vaults.

Further, the display systems of the prior art containing a rollout rack onto which a full casket is mounted basically require the presence of two caskets—one on a top shelf and the second on a bottom shelf. Such systems are difficult to manage and handle especially since the lower casket is often required to be in a retracted state.

The need exists therefore for a display system which permits the exhibition of a greater volume and a greater type of death related merchandise at greater ease for the prospective purchaser. In addition, the need exists for a display system which can be more easily assembled and utilized than afforded by the systems of the prior art.

SUMMARY OF THE INVENTION

A death care merchandise display unit which maximizes the types and styles of death care merchandise comprises two vertical, parallel, spaced wing wall panels and a vertical back wall having lateral edges secured to the rear edges of the wing wall panels. The display unit may contain a retractable rack connected to the two vertical spaced wing wall panels having a slide mechanism. The slide mechanism is preferably one having one of its members attached to the inside of the wing wall panel and another member attached to the retractable rack. The retractable rack typically is employed for displaying a burial vault, coffin or casket.

The display unit may further contain a cornice. In a particularly preferred embodiment, the cornice projects from the vertical back wall of the merchandise display area.

Further, the display unit of the invention may contain one or more retractable drawers in relatively close proximity to the rack(s) displaying the burial vault, coffin or casket.

In still another embodiment of the invention, slat or slot walls comprise at least a portion of the back wall; display shelving interconnecting the ridges within the slat walls for placement of urns and other death care merchandise.

Yet another embodiment of the invention is directed to a modular death care merchandise display unit having means for interconnecting two or more modular units.

BRIEF DESCRIPTION OF THE DRAWINGS

FIG. 1 is a frontal view of one embodiment of the display unit of the invention.

FIG. 2 is a side view of the display unit of FIG. 1 illustrating the retractability of the bottom rack.

FIG. 5 is a dual slide mechanism for use with the retractable drawer in the display unit of the invention.

DETAILED DESCRIPTION OF PREFERRED EMBODIMENT

The present invention provides an integrated display system for death care related merchandise. The display system of the invention is principally used in a preview room where selection of death care related merchandise by the decedent's loved ones occurs. In addition, the display system of the invention may be used in death related ceremonial areas such as the viewing room of a funeral home as well as at funeral and memorial services.

The display system of the invention is defined by a back wall and side or wing walls. One of the principal advantages of the display system of the present invention is that it maximizes the number and types of death care merchandise which may be displayed in a given area.

The display system of the invention may further be a modular assembly; permitting it to be assembled and disassembled within a short period of time as well as on an "as needed" basis. The ability of the display system to be modular permits purchasers to buy all or sections of the system when so desired.

The display system contains a number of novel features which may be used alone or in combination with each other. FIGS. 1 and 2 show an embodiment of the death care merchandise display system 10 of the invention, principally for use in preview rooms. The display system 10 comprises a back wall 12 and two side or wing walls 14 and 16. Wing walls 14 and 16 are connected with back wall 12 at the rear section of the wing wall. The vertical back wall 12 may be removably secured to the rear edges of wing walls 14 and 16.

Figure 3:
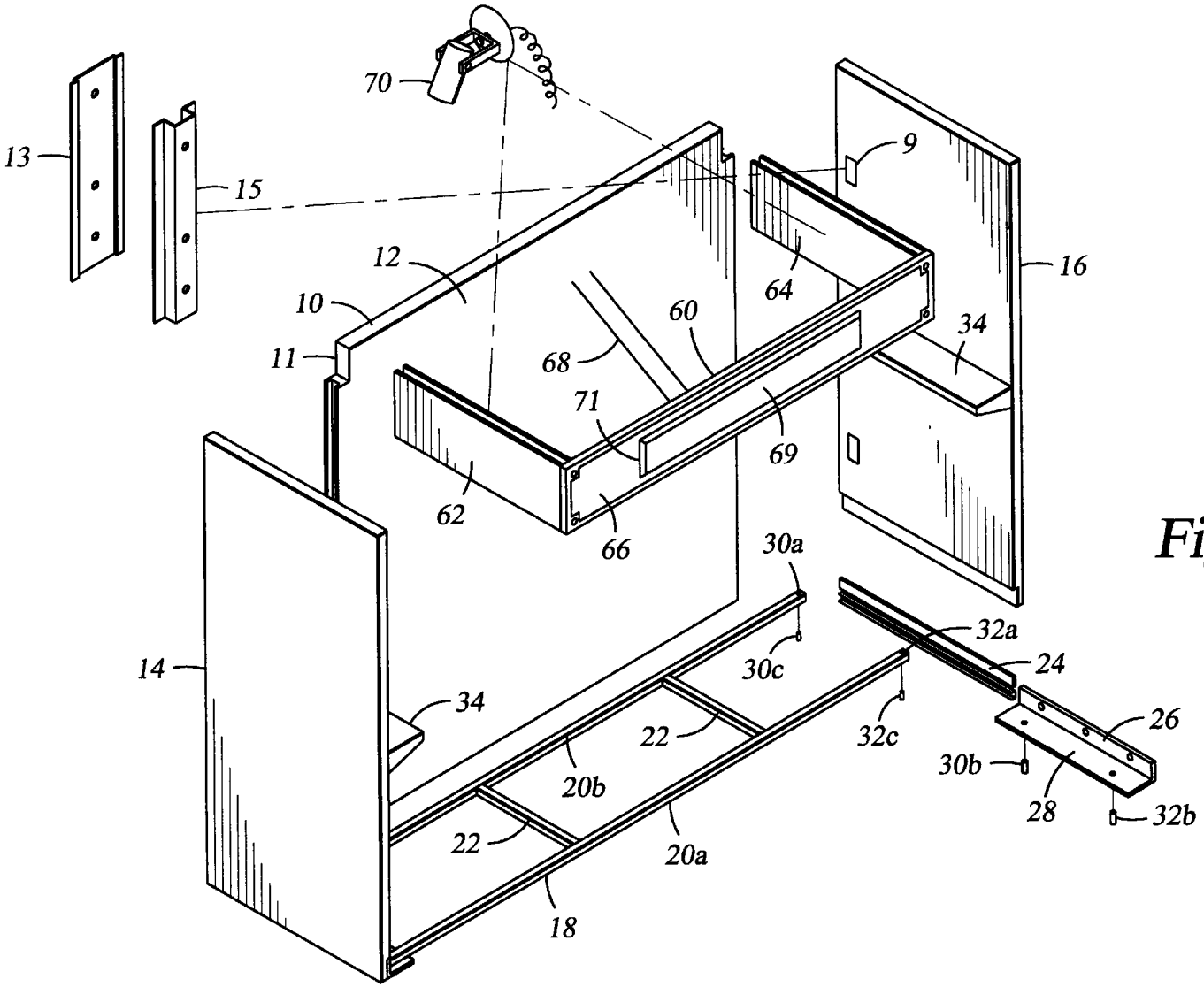
FIG. 3 is a frontal angled side view of a display unit of the invention.

As set forth in FIG. 3, wing wall panels 14 and 16 are attached to back wall panel 12 by conventional ready-to-assemble ("RTA") fittings in the art. Depicted are fitting 13 with flanges which mate with fitting 15 having an approximate ½" deep recessed area. Back wall panel 12 has an L-shaped cut 11 and wing wall panels 14 and 16 have receptor notch 9 for the RTA fittings.

The back and wing wall panels of the display system of the invention are typically plywood but may be fiberwood or other durable material such as a synthetic plastic material as plexiglass or Mylar. The back wall or wing wall(s) may be covered with a fabric-like material or have a textured surface. When so desired, the fabric-like material may be removably attached to the panel allowing the user to select the color and texture.

Back wall panel 12 and wing wall panels 14 and 16 may include known means for removably attaching objects such as signs and photographs. The means for attaching objects include, e.g., peg-board type attachments, slat wall, tackable surfaces, hook-and-loop fabric (e.g., VELCRO®) attachments, magnetic attachments or other known devices for removably attaching objects to a vertical surface for display of the objects.

The alcove defined by back wall panel 12, left wing wall panel 14 and right wing wall panel 16 may display one or more decedent confinement chambers 36. The decedent confinement chambers may be actual size, sectionals of actual size or miniatures. The alcove may contain stationary or retractable chambers or a combination thereof.

FIG. 1 illustrates an alcove having two actual size decedent confinement chambers. The lower chamber, 36*a*, rests on display rack 18. The upper non-retractable chamber, 36*b*, rests on shelfing brackets 34, which are secured to wing wall panels 14 and 16.

Display unit 10 may further contain identification placards 51 in front of decedent confinement chambers 36*a* and 36*b*. In preview rooms, placards 51 are used to inform the customer of features of the displayed casket. Signage 39 or other communicative materials may further be mounted on back wall 12 or wing walls 14 or 16 to designate information about the death related merchandise (when used in a showroom display setting) or the decedent (when used in a viewing room, funeral home or memorial service setting). When used in a preview room display setting, each of decedent confinement chambers 36*a* and 36*b* may be displayed with signage or other communicative means providing information to the prospective purchaser of the chamber. Signage 39 may be used in lieu of or in addition to placards 51.

The wing and wall panels, illustrated in FIGS. 1 and 2 are typically 5 to 7 feet, preferably 6 feet, tall. The length of back wall 12 is sufficient to contain an actual size decedent confinement chamber.

Rack 18 is preferably extendable from back wall panel 12. FIG. 2 illustrates a side view of FIG. 1 before and after the extension of rack 18 from the back wall panel. When fully extended, the interior of both decedent confinement chambers 36*a* and 36*b* may be viewed. Lid 38*b* may be fully raised. In addition, when rack 18 is in a retracted state, lid 36*a* of decedent confinement chamber 36*a* may be fully raised without abutting other elements of the display unit.

Retractable rack 18, when present, is an integral part of death care merchandise display system 10. As set forth in FIG. 3, rack 18 may consist of horizontal beam 20. Typically, two horizontal beams—shown as 20*a* and 20*b*—are employed to more evenly distribute the weight of the decedent confinement chamber. Vertical beam 22 connects the horizontal beams 20*a* and 20*b* and provides additional support to the rack. One or more vertical beams may be used.

The rack is typically metallic, such as steel or aluminum, and is of a construction capable of holding the weight exerted on it by the decedent confinement chamber.

The means for rolling rack 18 outwards for better view may be any slide assembly mechanism conventionally used for heavy-duty drawers, such as side mounted draw guide assemblies used in the manufacture of office furniture. As set forth in FIG. 3, such slide mechanisms may be characterized by a hollow U-shaped guide rail 24 fastened to the interior of each of the wing walls of the display unit and an extendible runner rail 26 which, when the rack is not retracted, is encased within the U-shaped guide rail 24. Runner rail 26 further consists of bottom plate 28 which is mounted to the ends of horizontal beam 20*a* at 30*a* with 30*b* by screw fastener 30*c*. Where two horizontal beams are employed, runner rail 26 contains additional mating end 32*b* for mounting to the horizontal beam at 32*a* with screw 32*c*. Where desired, the slide mechanism may further contain rolling bodies on the runner rail for engaging with the races in the guide rail.

Further, either the guide rail or the runner rail is preferably provided with a stopper that prevent the rack from being rolled out too far while allowing it to be pulled out far enough for the lid to be free of impediments.

Figure 4:
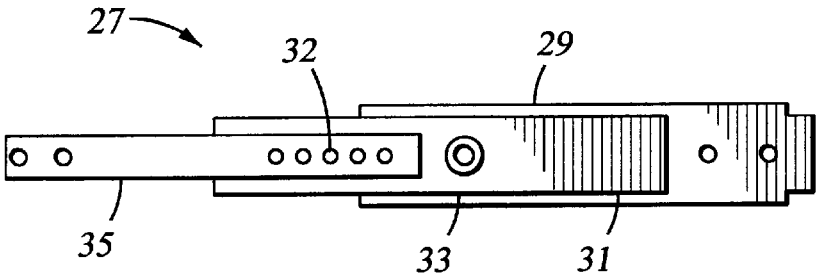
FIG. 4 is a frontal view of a preferred slide mechanism for use with the retractable drawer in the invention.
Figure 5A:
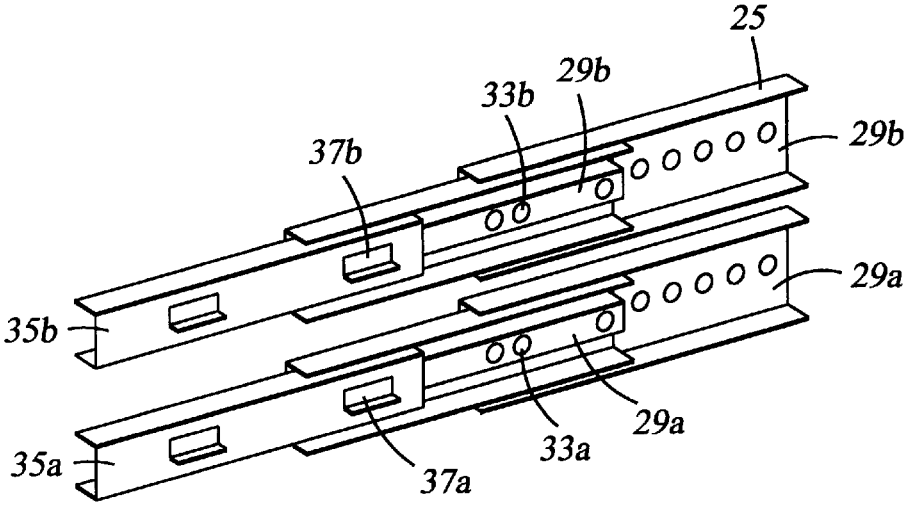
FIGS. 5*a* and 5*b* being frontal views.
Figure 5B:
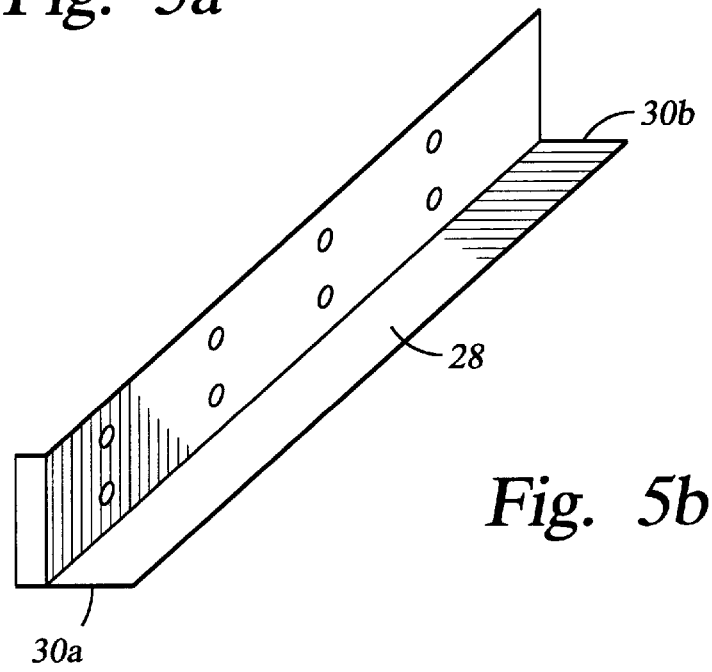

A particularly preferred slide mechanism for use in the invention is the drawer slide assembly 27 set forth in FIG. 4. A case member 29 is secured to the inner surface of each of the wing wall panels; the two case members being parallel to each other. Retractable intermediate member 31 is then secured to case member 29 through one or more access holes 33. Retractable drawer member 35 is then mounted to intermediate member 31 through mounting holes 37. A plate, similar to plate 28, rests on the bottom of case member 29 and serves to secure the assembly into mounting receivers 30*a* and 32*a* of horizontal beam 20 of rack 18. Such slide mechanism are commercially available as drawer slide No. 3320 from Hettich America, L.P. of Harrisonville, Mo.

Where rack 18 is to be employed with a ready-for-use decedent confinement chamber, it is preferred to use dual heavy duty extension slides to provide increased support. FIG. 5 exemplifies a dual slide mechanism. Referring to FIG. 5*a*, case members 29*a* and 29*b* are secured to the inner surface of each of the wing wall panels. The case members have top and bottom lips 25 for holding intermediate members 31*a* and 31*b* within case members 29*a* and 29*b*, respectively. Retractable intermediate members 29*a* and 29*b* are secured to the case members through one or more access holes 33*a* and 33*b*, respectively. Sliding drawer members 35*a* and 35*b* are then mounted to intermediate members 29*a* and 29*b* through mounting holes 37*a* and 37*b*, respectively. FIG. 5*b* illustrates an inside view of case member 29*a* having plate 28 with receivers 32*b* and 30*b* for securing thereto the horizontal beam.

As used herein, the term "decedent confinement chamber" shall refer to a casket, coffin or burial vault and, where appropriate, urns. The term shall include ready-for-use caskets, coffins and burial vaults as well as the facade of caskets, coffins and burial vaults. Where the display unit is to be used in a preview room and designed not to be opened, it is especially preferred to use facades of such caskets, coffins and burial vaults. The facade typically includes those outer sides and surfaces of the chamber visible to the observer. Where the chamber is being used to exhibit only the facade, the inner chamber is hollow.

The retractable rack illustrated in FIG. 3 may be used with caskets or coffins as well as burial vaults. The decedent confinement chamber may either be the facade of such chambers or a ready-for-use chamber. The facade of chamber 36*a* and 36*b* of FIG. 2 would include the top, front and sides of the chamber.

The display unit of the invention may contain more than one retractable decedent confinement chamber. When two retractable racks are so desired, a solid support (such as plywood or metal sheet) may rest on shelfing brackets 34 to give the upper retractable rack the requisite support. Alternatively, shelfing brackets 34 may be substituted with a solid support surface extending from (and secured to) left wing wall 14 to right wall panel 16. Drawer slide assembly units similar to those illustrated in FIGS. 3 and 5 would be used for both of the retractable decedent confinement chambers.

It is often desirable, especially where the display unit contains a retractable decedent containment chamber, to secure the unit to a stationary support. Thus, the back wall 12 may be secured to the adjoining wall (or sheetrock) surface of the building. Alternatively, or in addition to securing the back wall to the adjoining wall, the base of the wing wall or back wall may be bolted, by means of conventional fasteners, to the floor. By doing so, the potential torque on the display due to the extendible decedent confinement chamber will be counteracted.

The display unit of the invention may contain one or more non-retractable (stationary) racks either in addition to or in lieu of retractable rack 18. FIG. 1 illustrates shelving 34 for the mounting of a non-retractable decedent confinement chamber. Additional support for the chamber may be provided by extending shelving 34 the length of the interior of the alcove defined by back wall 12 and wing walls 14 and 16. Due to the torque imparted by the retractable rack in its extended position, it is best that the retractable rack be placed on the bottommost section of the display unit when a stationary rack is used in combination with a retractable rack.

Figure 6:
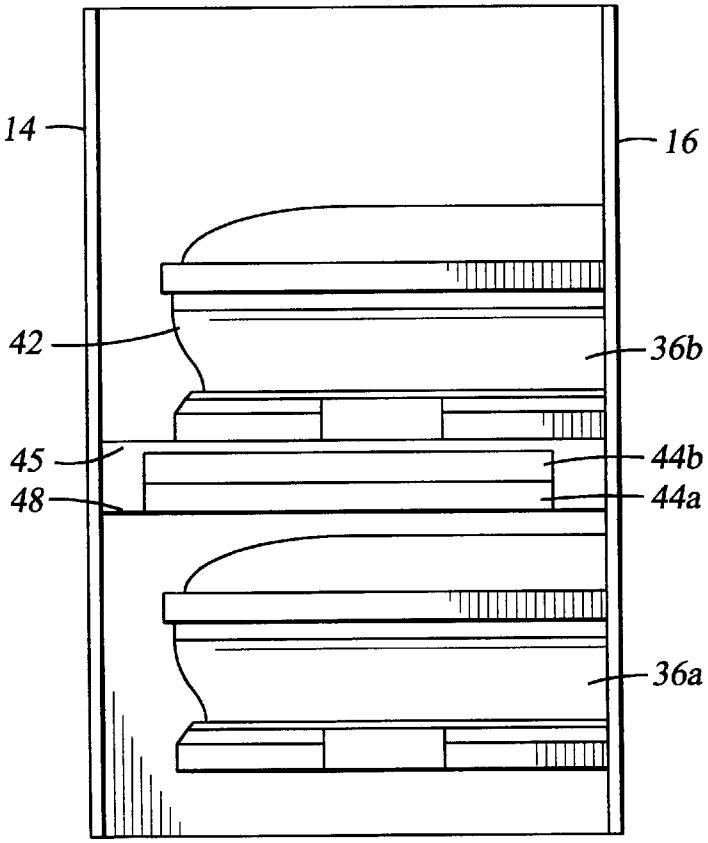

In order to increase the number and types of decedent confinement chambers being displayed, the display unit of the invention may further contain sectional decedent containment chambers. A sectional decedent containment chamber is a partial casket, coffin or burial vault cut in such a manner so as to be mounted on the receiving wall. FIG 6 illustrates an alcove containing two sectional decedent confinement chambers 36*a* and 36*b*. As set forth in FIG. 6, a sectional decedent containment chamber 40, cut at 90°, allows the observer to view the butt end 42 of the chamber along with all external ornamentation of the segmented chamber. The partial chamber may be a facade only or, when desired to be viewed with the lid in the open position, contain an interior view of the segmented chamber being presented.

Figure 7:
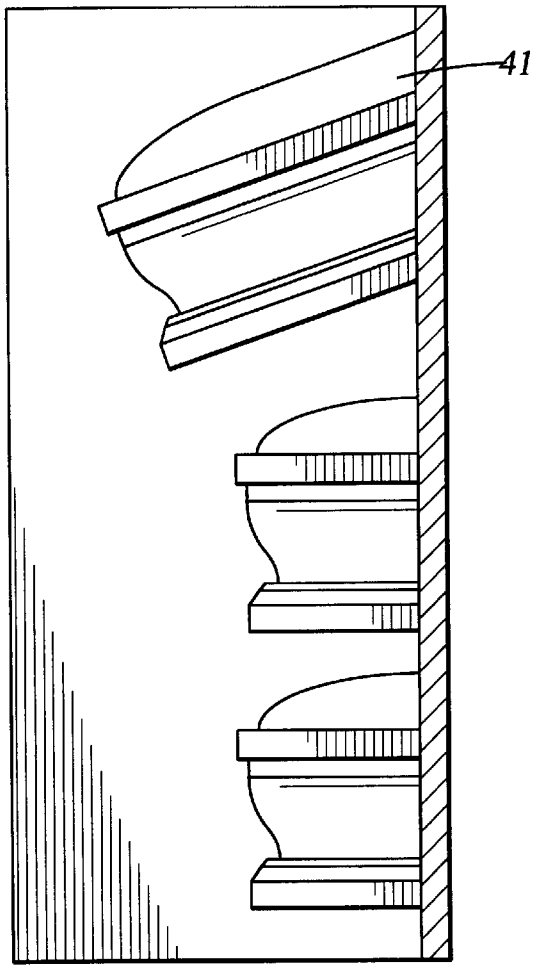
FIGS. 6 and 7 are frontal views of display units having two and three sectional decedent confinement chambers, respectively.

The decedent containment chamber for use in the invention may further be sectioned at an angle greater than 90°from the wall panel. For instance, as depicted in FIG. 7, the sectioned chamber 41 may be cut such that the butt end of the chamber is seen by the observer at an oblique angle. When secured on a flat wall, the sectional decedent containment chamber 40, allows the observer to more keenly view a chamber appearing higher with the alcove. In addition, the interior of an opened chamber is more easily viewable when the chamber is sectioned at an angle greater than 90°. When so sectioned, the partial chamber appears to the observer in a position which is slanted in a downward direction.

Figure 8:
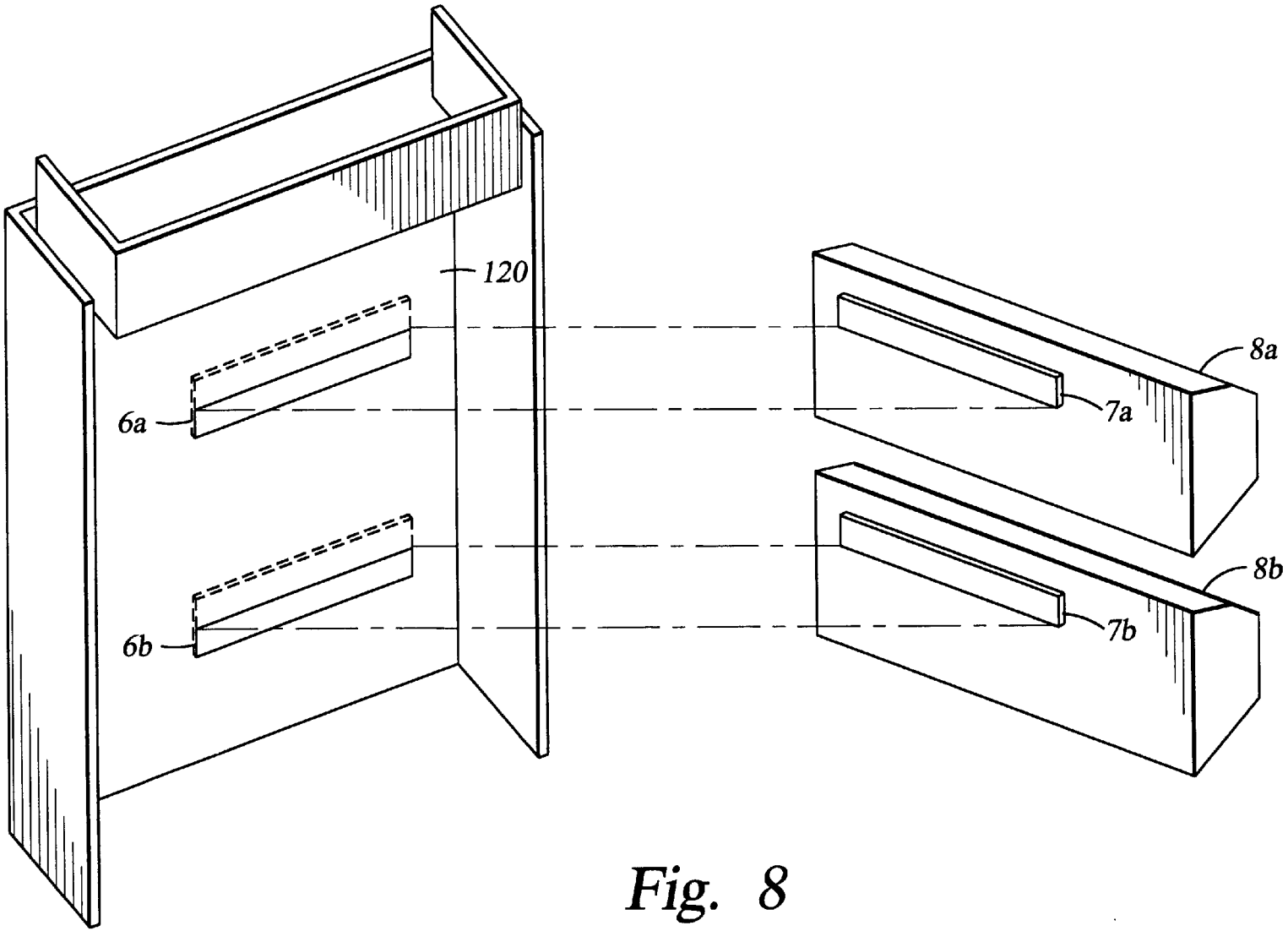
FIG. 8 details a method of securing the back end of a decedent confinement chamber to a wall of the alcove of the display unit.

Decedent confinement chambers including sectionals thereof may be easily mounted onto the wall of the alcove. FIG. 8 depicts the back end of a characteristic decedent confinement chamber used in the invention. The decedent confinement chambers 8*a* and 8*b* illustrated in FIG. 8 are "quarter caskets", each representing one quarter of a full size casket. As depicted, the unit is about six feet tall and four feet wide. The chambers have blocks 7*a* and 7*b* on their rear surface. The lower edges of blocks 7*a* and 7*b* are beveled, for mating with blocks 6*a* and 6*b*, which are beveled on their upper surfaces. The mating grooves of blocks 6*a* and 7*a* and blocks 6*b* and 7*b* create a French cleat 120 by which the chamber may be suspended on the wall.

The merchandise display unit of the invention may further contain one or more retractable drawers 44 or display boards for displaying accessories typically used with the decedent confinement chamber on display. Such accessories include fabrics for the cap panel—that portion of the interior of the chamber lining the upper part of the lid, as well as the overlay—the fabric which lies across the outside of the chamber when the lid of the chamber is opened. The drawer could further be modified to hold the samples of ornamental trims for the exterior of the chamber being displayed.

Figure 9:
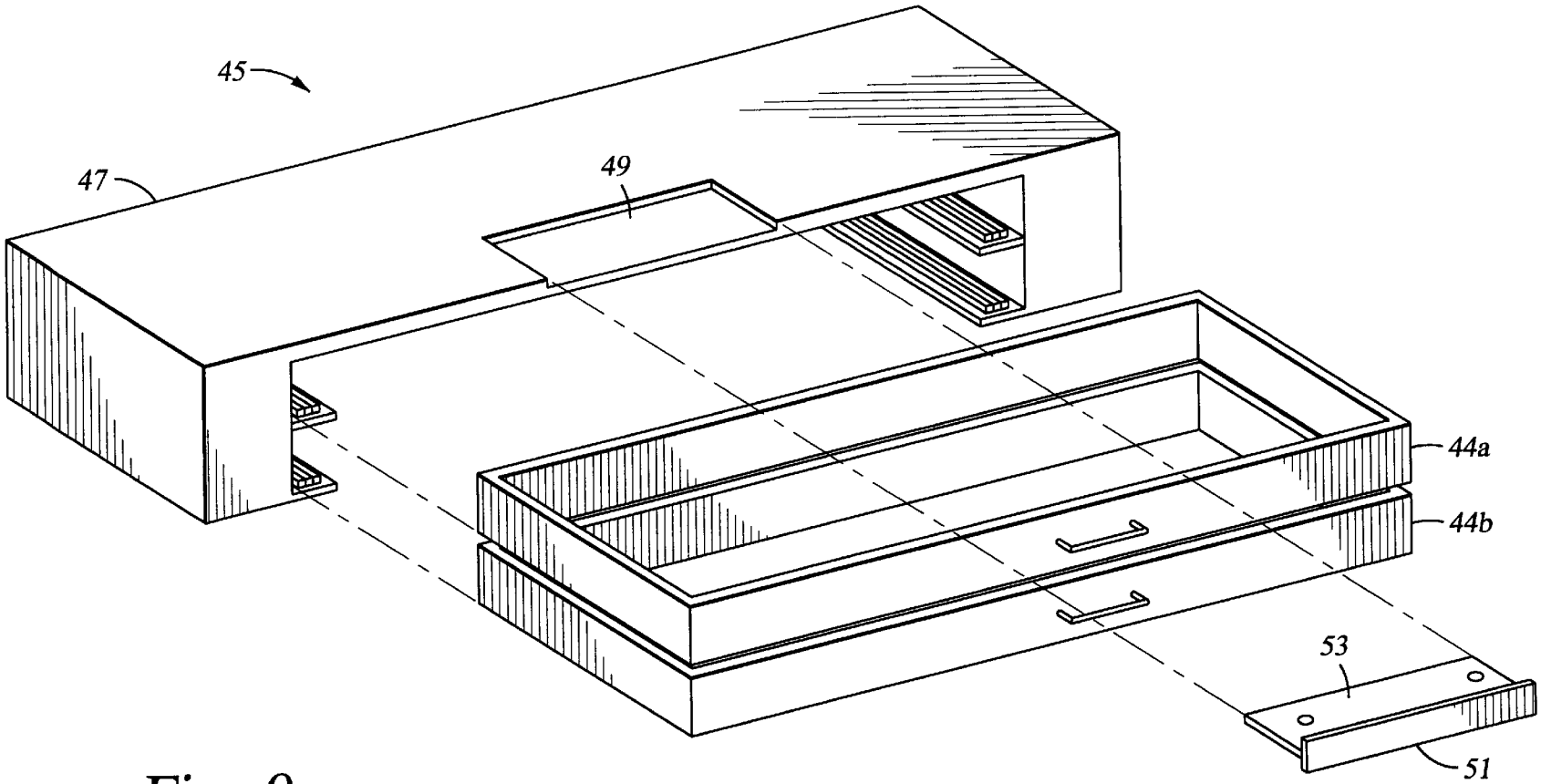
FIG. 9 is an exploded view of the drawer assembly unit for use with the invention.

The retractable drawer unit 45 of FIG. 9 consists of two sets of retractable drawers 44*a* and 44*b*. In operation, each of the drawers may display adornment materials for separate decedent confinement chambers. The drawers are retractable by conventional bottom mounted drawer slides conventional in the art. The top surface 47 of the drawer unit 45 may contain recessed area 49 for placement of sign placard 51. Base 53 of placard 51 fits within recessed area 49. The front surface of the placard may contain additional information about the chamber on display (where used in a preview room) or the decedent (where used in a funeral home or memorial service setting). As illustrated in FIG. 6, retractable drawer unit 45 may extend from wing wall 14 to wing wall 16. Top shelf 47 of drawer unit 45 may form the support for decedent confinement chamber 42 as displayed in FIG. 6.

Figure 10B:
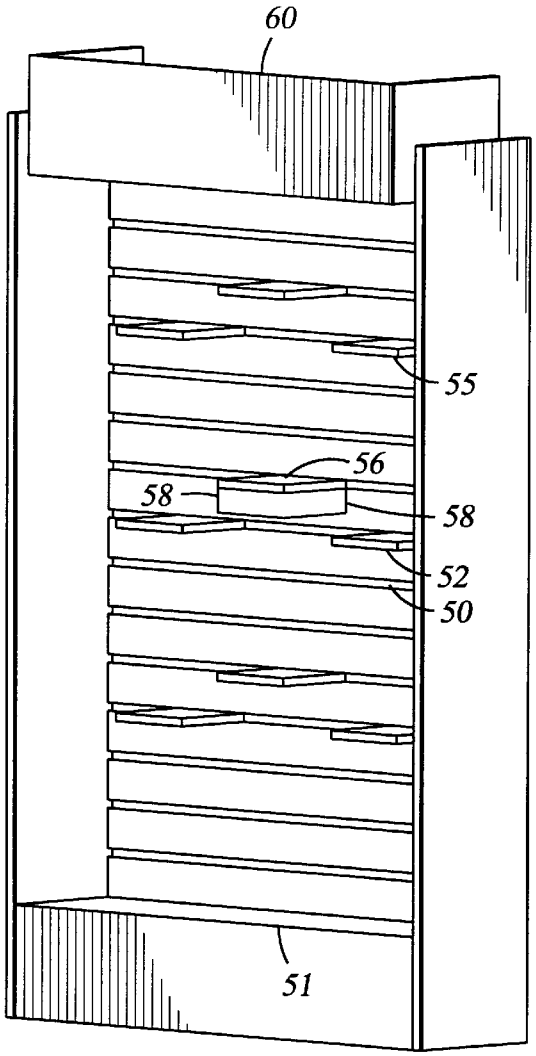
FIG. 10 is an alcove for possible use with the invention having slat wall.
Figure 10A:
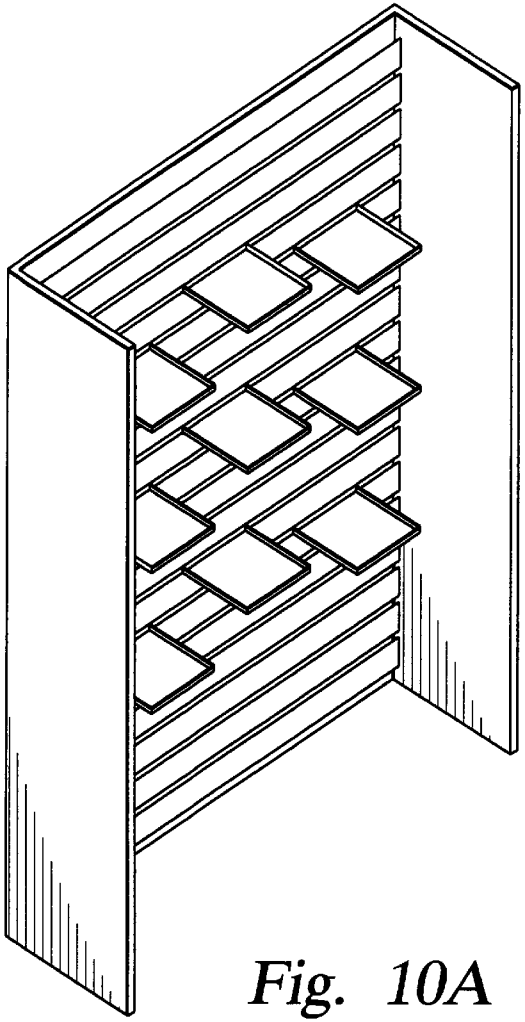

Either or both the back wall or the wing wall panels of the merchandise display system of the invention may be comprised of slat wall. FIG. 10 illustrates a wall of the alcove containing slat wall 50. Shelving is set within the recessed grooves 52 defined by slat wall 50. Elbow shelving 54 joining one recessed groove of a slat wall with another may further be used in place of planar shelving 55. Elbow shelving consists of a horizontally flat section 56 onto which the merchandise is displayed, and support 58, angled to fit an adjacent recessed groove.

Merchandise such as urns and miniature decedent confinement chambers may be displayed on slat wall shelving.

The base 51 of the slat wall alcove may be raised for display of other objects. The use of slat walls has particular applicability in the display of miniaturized decedent confinement chambers, such as miniaturized burial vaults or caskets.

The merchandise display system of the invention may further contain a cornice. Any conventional cornice or soffit disclosed in the art may suffice. For instance, the cornice may consist of a horizontal beam which extends from wing wall 14 to wing wall 16. Typically, the use of a cornice will increase the display height to above 7 feet. In a preferred embodiment, the height of the wing wall panels and back wall panels, when cornice is added, is about 7.5 feet.

A particularly preferred cornice is that set forth in FIG. 3 which is easy to produce and which affords to the display a more than adequate amount of light. The cornice 60 is mounted along the back wall 10 of the display unit, preferably within the upper portion of the back wall. The cornice is principally composed of a left cantilevered vertical beam 62 and a right cantilevered vertical beam 64, both of which extend from back wall 10. Horizontal beam 66 is mounted at the frontal edges of vertical beams 62 and 64.

The horizontal beam 66 of the cornice assembly 60 extends along the majority of the back wall of the display system. Horizontal beam 66 is affixed to the display system 10 by means of the two vertical beams 62 and 64 which extend from backwall 12. Horizontal beam 66 of the cornice typically extends greater than 50% of the length of the back wall of the merchandise display system; most typically along the entire length of the merchandise display unit. One or more mounting supports 68 may be disposed in spaced relationship from back wall 10 to horizontal beam 66 where necessary to provide additional support.

An illuminating source may be concealed to the observer within the interior of the cornice design, preferably along the vertical beams of the cornice system. Exemplary of the illumination source are one or more track or pendant lights 70 which may easily be manipulated such that the light is directed onto selected merchandise within the display system. Track or pendant lights 70 are secured by conventional screws or nuts and bolts to the inside surface of vertical beams 62 and/or 64.

Figure 11:
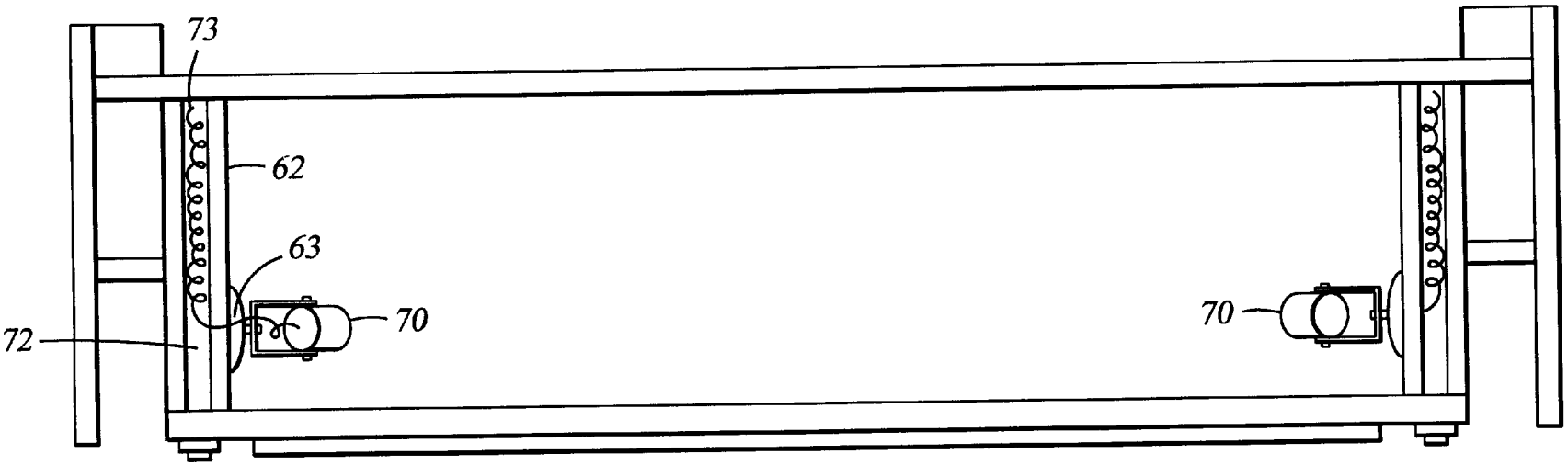
FIG. 11 is a top view of the cornice assembly for use in the invention.

As set forth in FIG. 11, the top surfaces of vertical beams 62 and 64 which contain an illuminating source contain recessed chambers 72 for storing the electrical cable wiring. The wiring leads out of the cornice assembly through aperture 73 and is plugged into the electrical outlet behind the back wall. The cable wiring for illumination means 70 leads through aperture 63 in vertical beam 62 up to recessed surface 72 and exits the cornice assembly through aperture 73. The electrical wiring is not evident to the observer of the display unit.

The horizontal beam of the cornice assembly may contain information center 69 for the display of information about either the decedent (where the unit is employed in memorial settings or funerals) or the merchandise displayed (where the unit is employed for point-of-sale merchandise). For instance, in point-of-sale merchandise, the information center can display information about the materials used in the manufacture of the decedent confinement chamber, such as "Stainless Steel", "Veneer", "Hardwood", "Steel", etc. as well as information about the merchandise on display, such as "Interiors" for a display illustrating the interior of the decedent confinement chamber.

Information center 69 may be imprinted on a decorative plate which may be secured onto the top surface of horizontal beam 66 directly or fitted into a recessed area on the horizontal beam. In a preferred embodiment, the horizontal beam of the cornice contains a decorative trim 71 complementary to the trim of the display system. The decorative trim may run the perimeter of information center 69.

Figure 12:
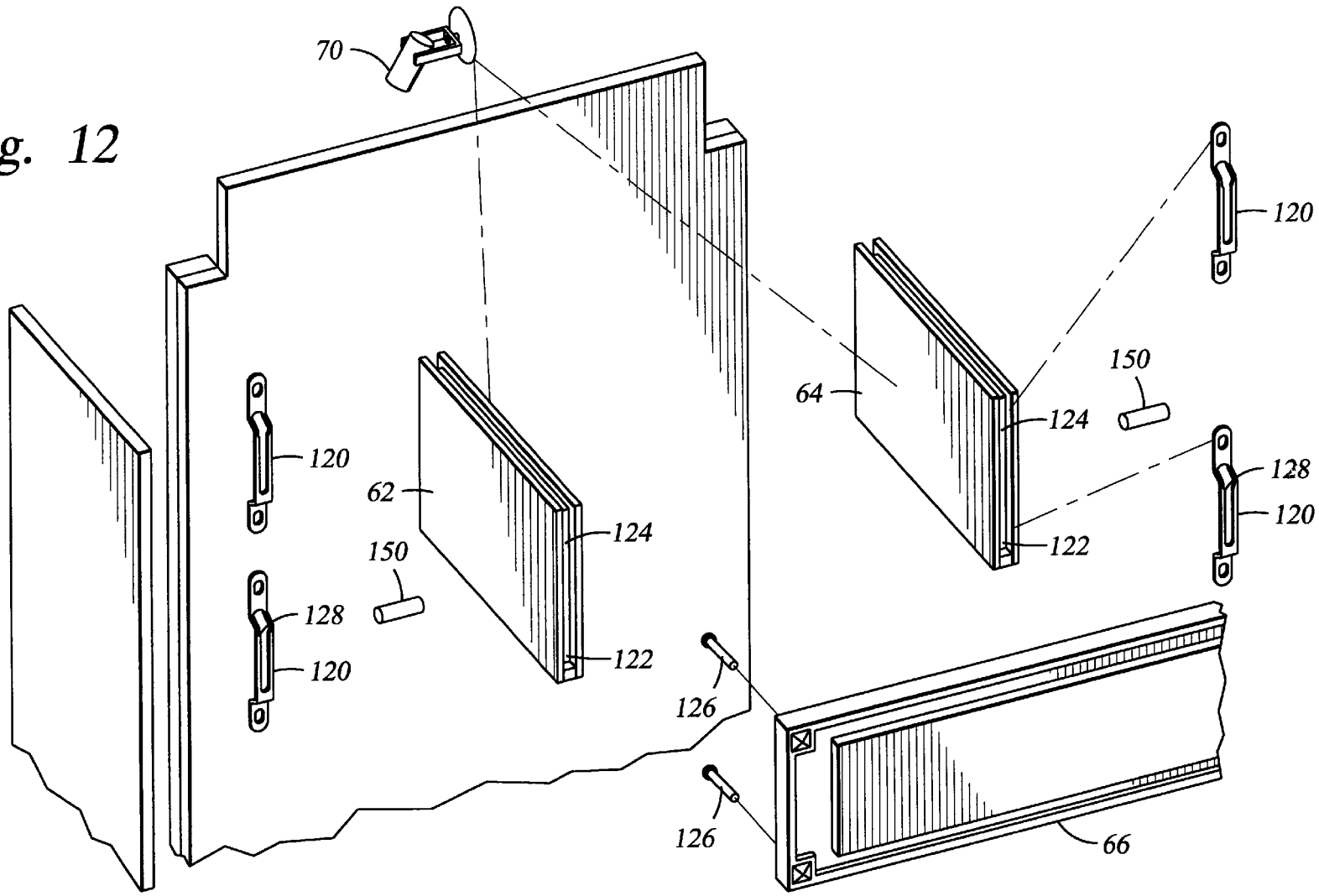
FIG. 12 is an exploded view of the cornice assembly secured to the back wall.

The vertical beams 62 and 64 in FIG. 12 of the cornice may be secured to the back wall of the display unit and the horizontal beam secured to the vertical beam by various known means, e.g., by a RTA fitting, by a threaded screw connection, by gravity lock method, or otherwise as known to those in the art. The preferred connecting member is the ready-to-assemble ("RTA") fitting 120, which includes a threaded fastener such as a machine-threaded screw extending longitudinally outward from the end of the receiving member and attached to a threaded nut or other threaded retaining device. For instance, the screw head of the RTA fitting may extend from the back wall of the connecting member. Receiving member is attached to the receiving end.

FIG. 12 demonstrates one method of securing the cornice assembly to back wall 12. Vertical beams 62 and 64 are secured to back wall 12 by threaded screws extending from the back of back wall panel 12 into the vertical beam. Mounting brackets are secured to the top 124 and bottom 122 of the front vertical beams 62 and 64. Mating screws are inserted into the back of horizontal beam 66 which interlock within the groove 128 of mounting bracket 120.

Figure 13:
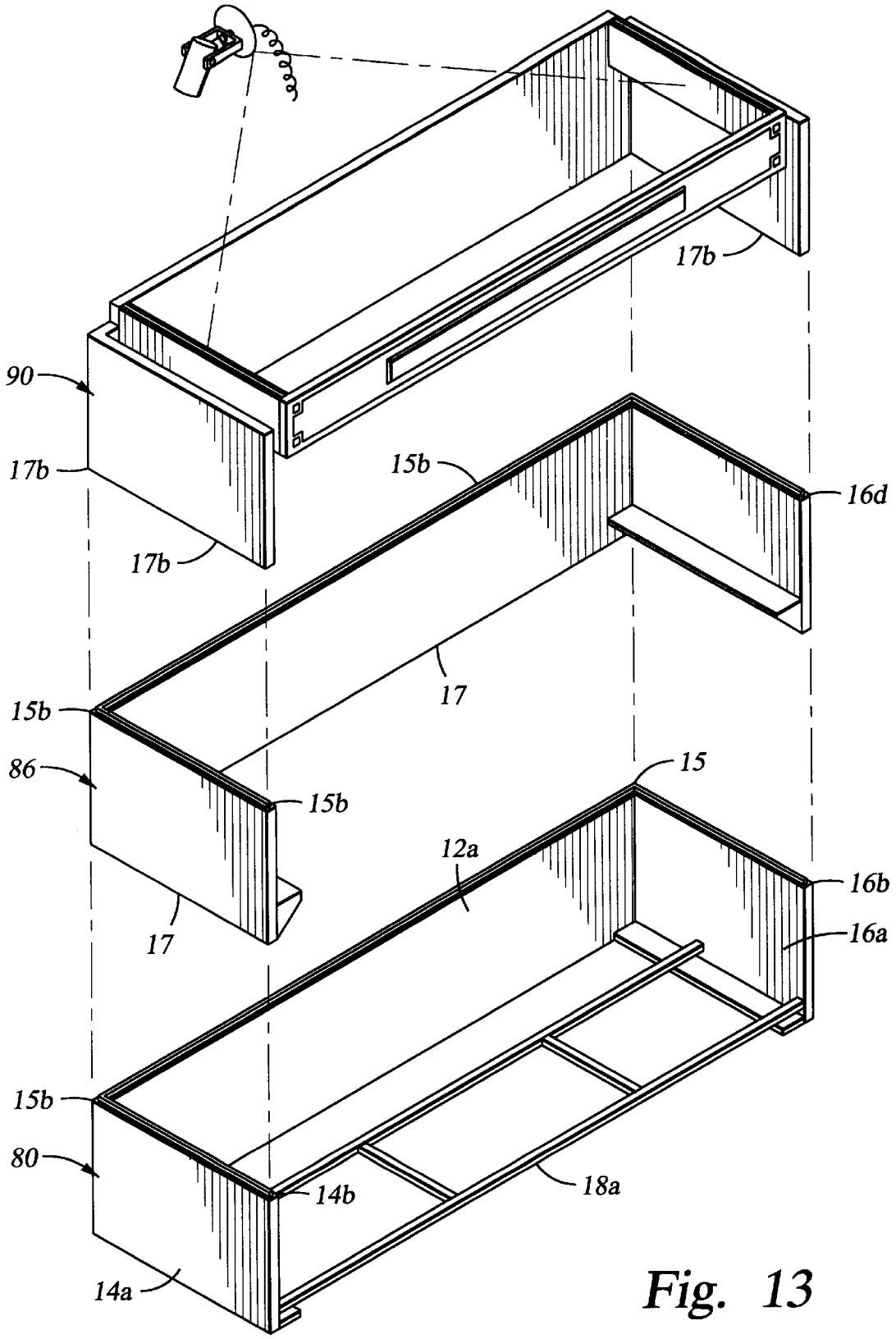
FIG. 13 is an exploded view of the modular display unit of the invention.

The configurations for use in the invention may further be characterized as a modular display system wherein modular units are prefabricated and are removably attached to one another to create the desired alcove configurations. In this manner, pieces of the display unit may be mixed or matched as well as be purchased concurrently with each other or at different times. FIG. 13 exemplifies the modular display unit. The base unit 80 of the modular system contains back wall 12*a* secured to wing wall panels 14*a* and 16*a*. The top surfaces of wing wall panels 14*a* and 16*a* as well as the top surface of back wall 12*a* has a lip 15 as more clearly detailed in FIG. 14. The bottom 17 of second modular unit 86 is recessed and interlocks with lip 15 of base unit 80. Alternatively, the top of base member 80 may interlock with the bottom of second modular unit 86 by other conventional means.

Second modular unit 86, in turn, contains lip 15*b* on the top surface of left wing wall, right wing wall and back wall panel for engaging the recessed groove running the bottom perimeter of third modular unit 90.

As depicted in FIG. 13, base modular unit 80 contains retractable rack 18*a* for a decedent confinement chamber. The features of this rack are identical to that described herein for FIG. 3. In place of retractable rack 18*a*, base modular unit 80 may contain any of the features discussed herein for the death care merchandise display. For instance, base modular unit 80 may contain, in place of retractable rack 18*a*, shelving, such as that illustrated in FIG. 1 as 34 for a stationary decedent confinement chamber or may contain the requisite hardware for receiving a butt end display for sectional decedent confinement chambers. The third modular unit 90 may contain a cornice (illustrated in FIG. 3) with or without illumination means.

Figure 14:
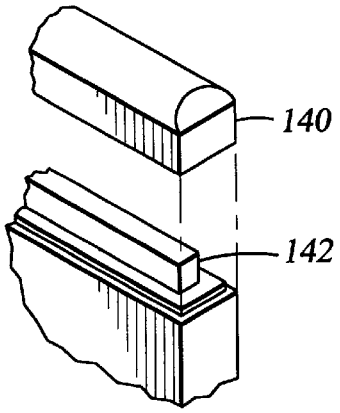
FIG. 14 illustrates a decorative endcap for the modular display unit of the invention.

Decorative endcap 140, as shown in FIG. 14, further may be adfixed to the top lip of either base unit 80, second modular unit 86 or third modular unit 90. Endcap 140 has a recessed groove which interlocks with the lip 142 of the uppermost unit of the display. The endcap can easily be unsnapped off of the lip to add additional modules when so desired.

The base unit of the modular system, as well as the lower portion of the nonmodular display system of the invention, may further comprise (i.) a tubing base assembly which may contain, where a retractable rack is needed, a pullout track assembly; and (ii.) the wall assembly comprising back wall and wing wall panels. The retractable rack may further be a part of the tubing base assembly.

Figure 15:
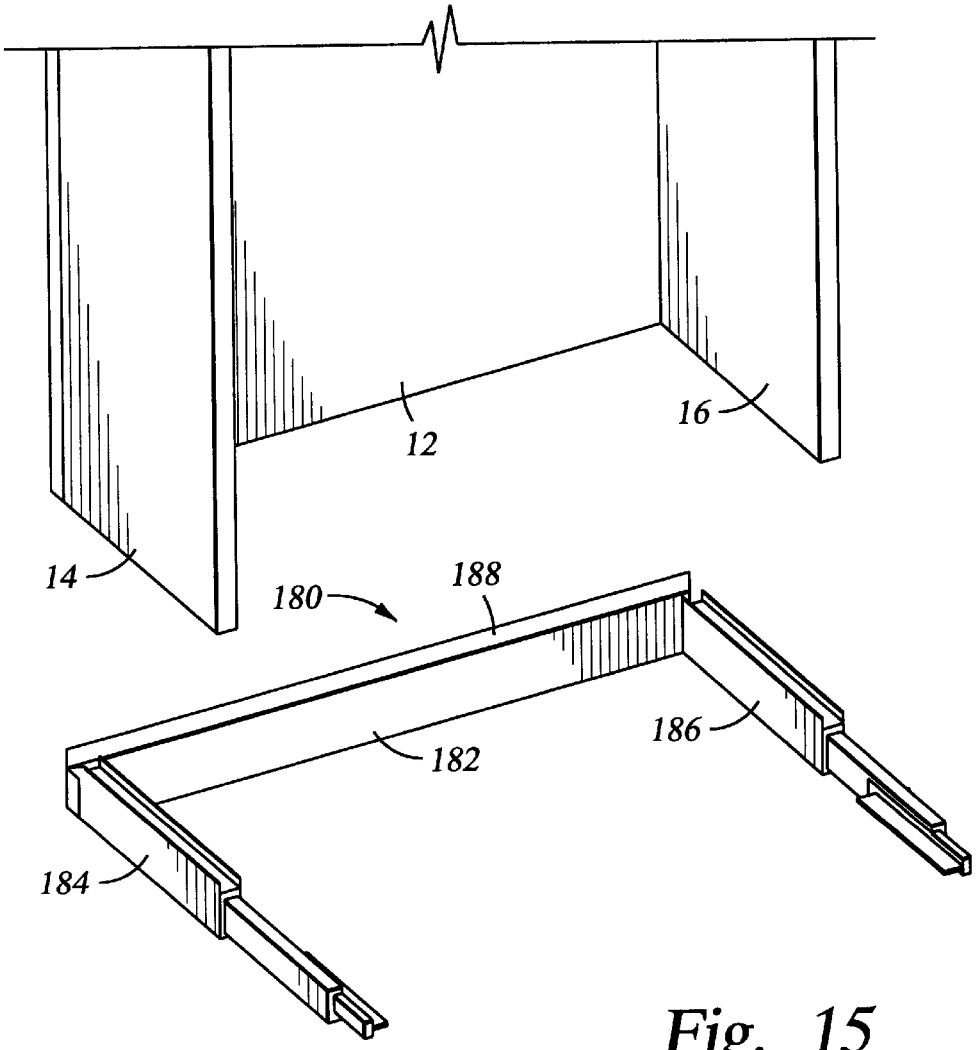
FIG. 15 is an exploded view of the modular (or non-modular) display unit having floor tubing member.
Figure 16:
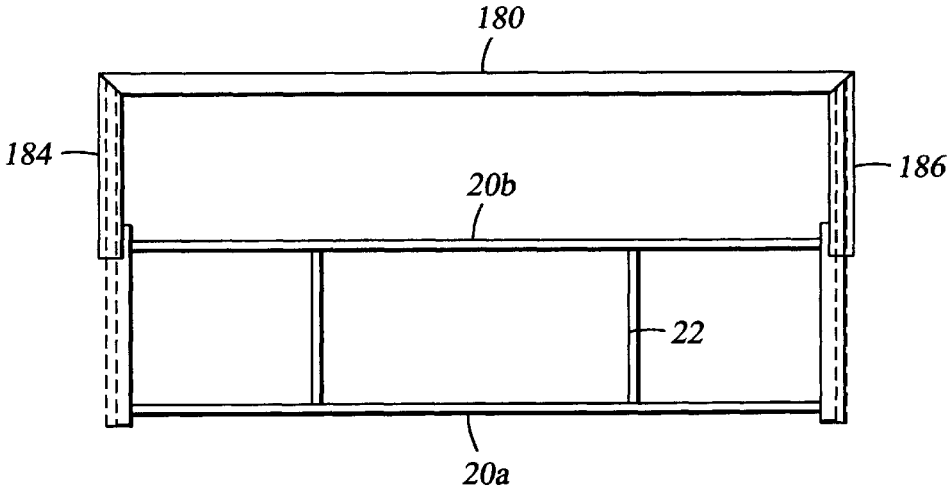
FIG. 16 is a top view of the display of floor tubing member of FIG. 15.
Figure 17:
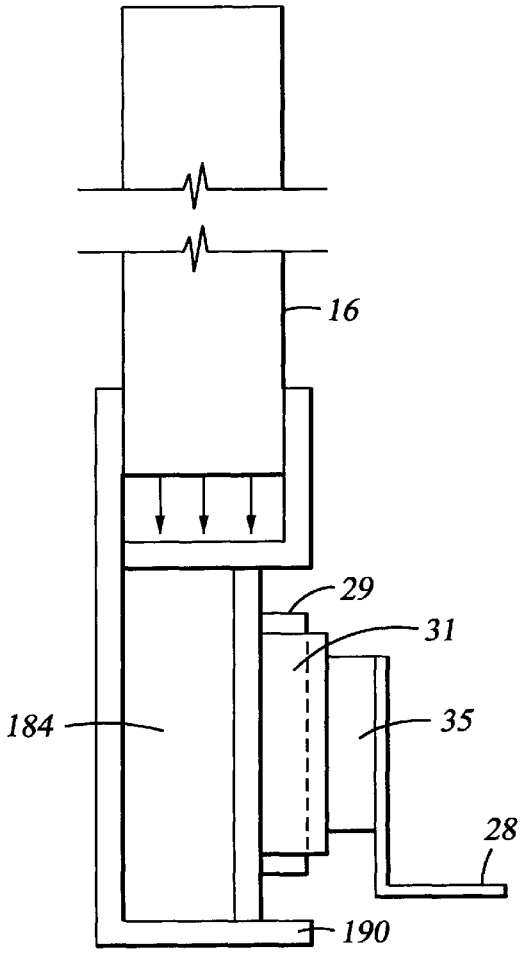
FIG. 17 is a cross-sectional view of the left wing floor tubing member of FIG. 16.

FIG. 15 demonstrates tubing assembly 180 comprising wing tubing 184 and 186 and back wall tubing 182. Tubing 184,186 and 182 may be composed of any durable material including steel and aluminum. In a preferred embodiment, this tubing is extruded aluminum. It may be produced as a single piece (as shown in FIG. 15) or consist of three interlocking separate pieces. This tubing is further preferably hollow as depicted in FIG. 17. The perimeter of the wing wall and back wall tubing further contains a recessed area 188 along its upper perimeter in which the wing wall panels 14 and 16 and back wall panel 12 of the alcove may be secured.

Where the display system is to employ a retractable decedent confinement chamber, slide mechanisms are attached to the tube wing panels 184 and 186. As set forth in FIG. 16, tubing assembly 180 may further contain the rack 18 as illustrated in FIG. 3.

Figure 18:
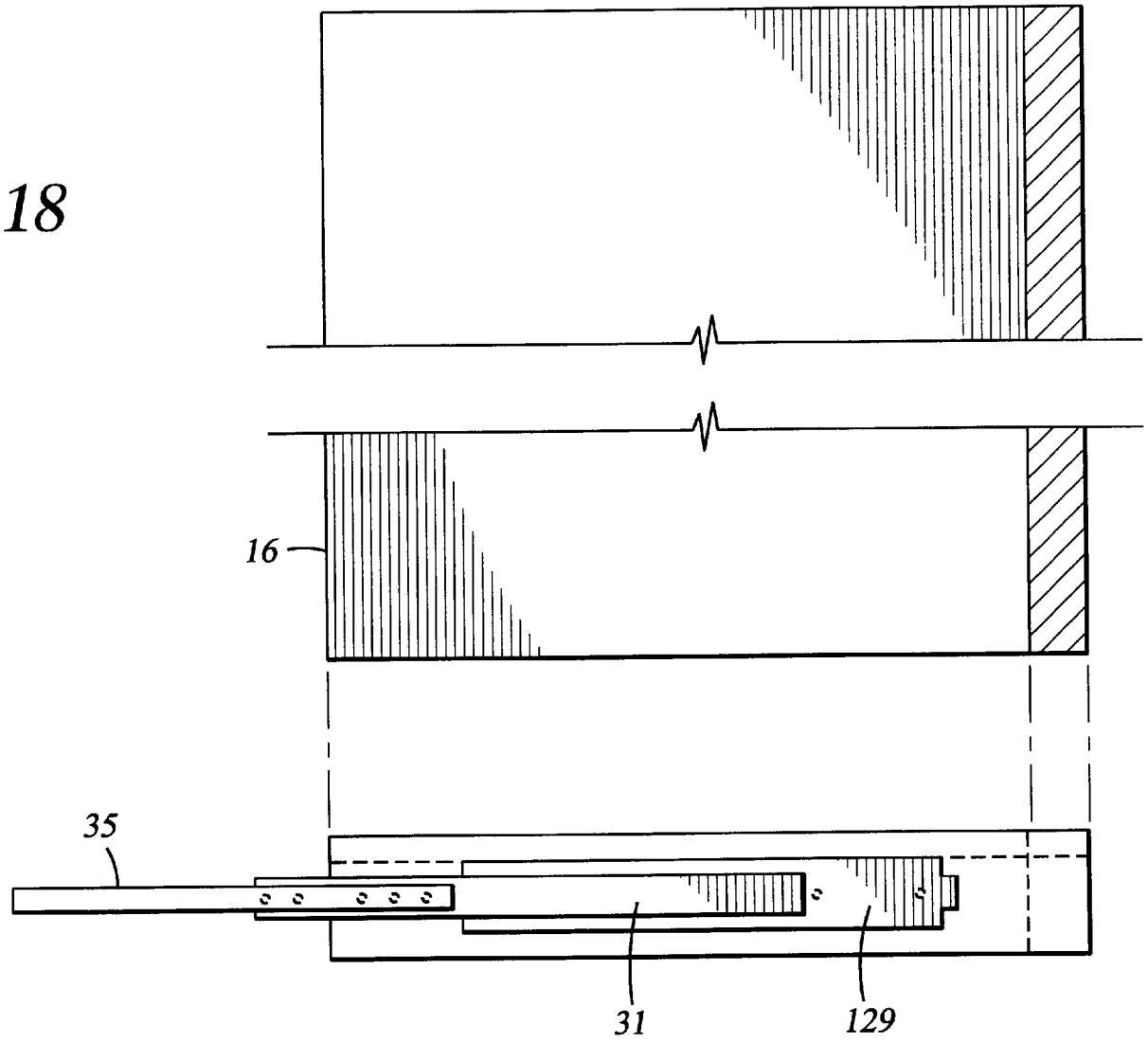
FIG. 18 is a cross-sectional view of left wing floor tubing member of FIG. 16.

FIGS. 17 and 18 are cross-sectional areas of the tubing assembly guiding slide mechanism. As presented, the slide mechanism may correspond to the same slide mechanism presented in FIG. 4; casing 29 being secured to the inner wall of wing tubing 184 and wing tubing 186. A lip 190 may project from the wing tubing to shield the slide assembly from contact.

Figure 19:
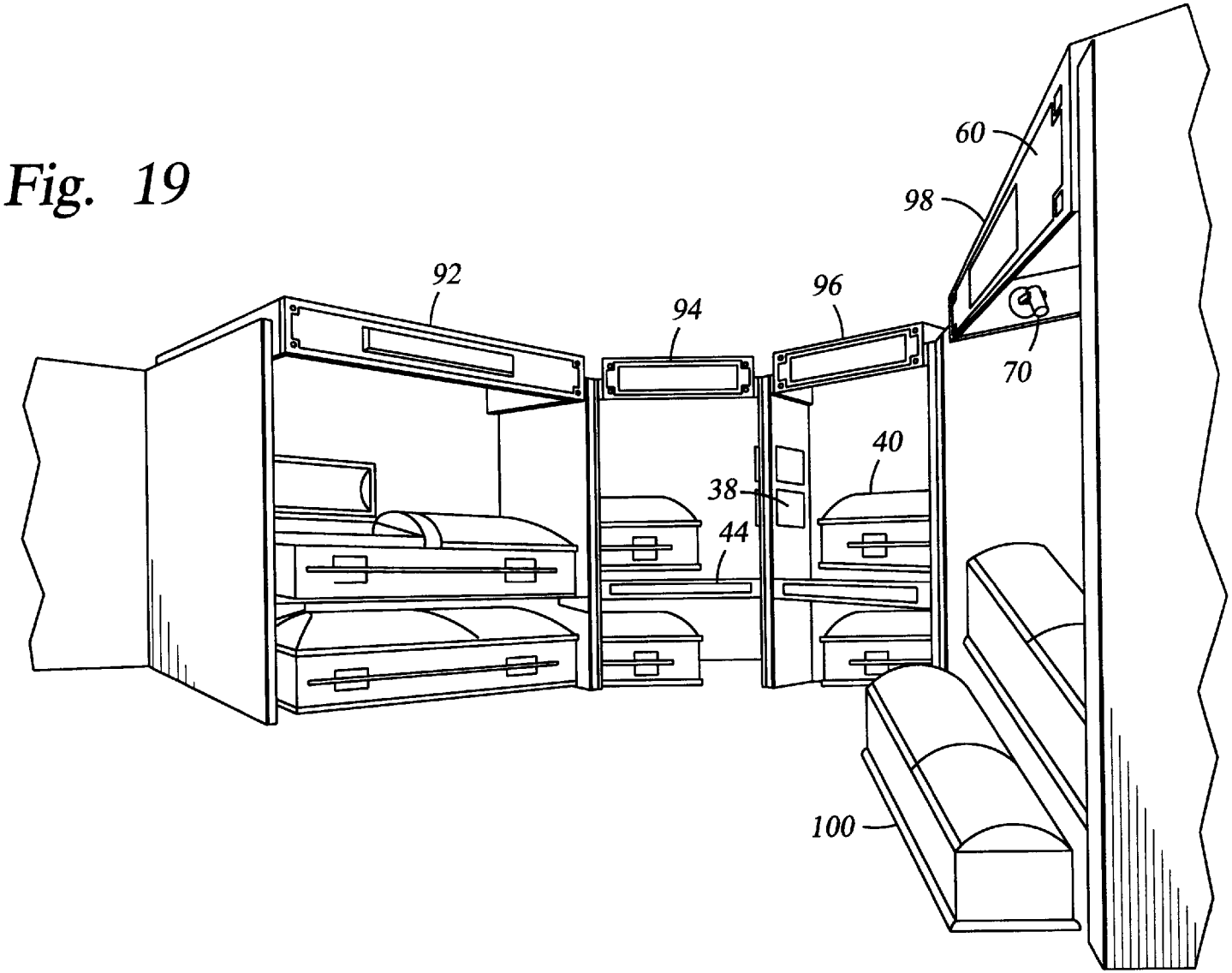
FIG. 19 is a frontal view of a death care merchandise display unit containing multiple alcoves.

Some or all of the above embodiments of the invention may be configured to present multiple alcoves, principally for use in preview rooms. FIG. 19 depicts four alcoves 92, 94, 96 and 98. Alcoves 94 and 96 present sectional caskets (approximately one quarter size). Alcoves 92 and 98 present top and bottom full size caskets. The lower casket 100 in alcove 98 is on a retractable rack. Cornice 60 of alcove 98 contains track or pendant light 70.

Alcove 96 further contains signage 38, principally used for recording information about the merchandise within the alcove. It further contains retractable drawers 44, principally used for adornment merchandise. Wing wall panels adjoining two adjacent alcoves may share a common wall panel. Alternatively, the display may consist of distinct alcoves contiguous with each other. To give each of the units a more uniform look, dowel 150, as set forth in FIG. 12, may extend from the wing wall panel into vertical beam of the cornice. Recessed receptors in the vertical beam and wing wall panel serve as the acceptor for the end of the dowel.

A finish on any or all of the surfaces of the merchandise display unit may be placed to more closely coordinate with the merchandise being displayed. For instance, where the merchandise display is of caskets or coffins, the back and side walls of the display unit may be pigmented to enhance the colors of the merchandise.

Various modifications may be made in the nature, composition, operation and arrangement of the various elements, steps and procedures described herein without departing from the spirit and scope of the invention as defined in the following claims.

We claim:

1. A death care merchandise display unit comprising:

two vertical, parallel, spaced wing wall panels;

a vertical back wall having lateral edges secured to the rear edges of said wing wall panels, said back wall supporting said wing wall panels, and maintaining them in a vertical attitude; and a retractable rack for a decedent confinement chamber, comprised of a front and rear horizontal beam, the ends of the horizontal beams connected by a vertical beam, said rack being positioned between the two vertical spaced wing wall panels and attached thereto by means of a slide mechanism.

2. The death care merchandise display unit of claim 1, wherein the slide mechanism consists of one member attached to the inner side of the wing wall panel and a second member attached to the vertical beam of the rack.

3. The death care merchandise display unit of claim 1, further comprising a stationary rack or shelf located above the retractable rack.

4. The death care merchandise display unit of claim 1, further comprising at least one retractable drawer above said retractable rack for storage of adornment materials.

5. The death care merchandise display unit of claim 3, further comprising at least one retractable drawer in close proximity to the stationary rack for storage of adornment materials.

6. The death care merchandise display unit of claim 1, further comprising a cornice.

7. The death care merchandise display unit of claim 3, further comprising a cornice.

8. The death care merchandise display unit of claim 5, further comprising a cornice.

9. A death care merchandise display unit comprising:

two vertical, parallel, spaced wing wall panels having vertical rear and front edges;

vertical back wall panel having lateral edges secured to said rear edges of said wing wall panels, said back wall means supporting said wing wall panels, and maintaining them in a vertical attitude;

a retractable rack positioned between the two vertical spaced wing wall panels, the retractable rack comprised of a front and rear horizontal beam, the ends of the horizontal beams connected by vertical beams, said rack being attached to the inner side of the wing wall panels by means of a slide mechanism; and a decedent confinement chamber placed on top of said retractable rack.

10. The death care merchandise display unit of claim 9, wherein the slide mechanism consists of one member attached to the inner side of the wing wall panel and a second member attached to the vertical beam of the retractable rack.

11. The death care merchandise display unit of claim 9, further comprising a stationary rack above the retractable rack onto which is placed a second decedent confinement chamber.

12. The death care merchandise display unit of claim 9, wherein the decedent confinement chamber on said retractable rack is a casket.

13. The death care merchandise display unit of claim 11, wherein the second decedent confinement chamber is a casket.

14. The death care merchandise display unit of claim 11, wherein the decedent confinement chamber on said retractable rack and the second decedent confinement chamber are both caskets.

15. The death care merchandise display unit of claim 9, further comprising at least one retractable drawer above said decedent confinement chamber on said retractable rack for storage of adornment materials.

16. The death care merchandise display unit of claim 11, further comprising at least one retractable drawer in close proximity to the decedent confinement chamber on said stationary rack for storage of adornment materials.

17. The death care merchandise display unit of claim 9, further comprising at least one sectional decedent confinement chamber selected from the group consisting of caskets, burial vaults, and coffins attached to either the back wall or a wing wall panel.

18. The death care merchandise display unit of claim 17, wherein the sectional decedent confinement chamber is a casket.

19. The death care merchandise display unit of claim 17, wherein the sectional decedent confinement chamber extends from a wing wall panel at an angle greater than 90° relative to the wing wall panel.

20. The death care merchandise display unit of claim 18, wherein the sectional casket extends from a wing wall panel at an angle greater than 90° relative to the wing wall panel.

21. The death care merchandise display unit of claim 9, further comprising a cornice.

22. The death care merchandise display unit of claim 11, further comprising a cornice.

23. The death care merchandise display unit of claim 17, further comprising a cornice.

24. A death care merchandise display unit comprising:

two vertical, parallel, spaced wing wall panels and a back wall having lateral edges secured to the rear edges of the wing wall panels, the back wall supporting said wing wall panels, and maintaining them in a vertical attitude; said back wall further containing slat walls; and at least one shelf secured to a slat wall for placement thereon a decedent confinement chamber or a sectional and miniature thereof.

25. The death care merchandise display unit of claim 24, further comprising a cornice.

26. The death care merchandise display unit of claim 24, further comprising a decedent confinement chamber or a sectional or miniature thereof.

27. The death care merchandise display unit of claim 26, further comprising a cornice.

28. The death care merchandise display unit of claim 26, wherein the decedent confinement chamber is a coffin, casket, burial vault, urn or a sectional or miniature thereof.

29. The death care merchandise display unit of claim 28, wherein the decedent confinement chamber is an urn.

30. The death care merchandise display unit of claim 28, wherein the decedent confinement chamber is a miniature of a burial vault.

31. A death care merchandise display unit comprising:

two vertical, parallel, spaced wing wall panels and a back wall having lateral edges secured to the rear edges of the wing wall panels, the back wall supporting said wing wall panels and maintaining them in a vertical attitude;

at least one decedent confinement chamber secured by its side surface onto the back wall and/or wing wall panel of the display unit, wherein the decedent confinement chamber is selected from caskets, coffins, burial vaults and sectionals or miniatures thereof.

32. The death care merchandise display unit of claim 31, further comprising a second decedent confinement chamber positioned between the two vertical spaced wing wall panels and resting on top of a retractable rack and attached thereto by means of a slide mechanism wherein one member of the slide mechanism is attached to the inside of one wing wall panel and the other member is attached to the outside surface of the decedent confinement chamber.

33. The death care merchandise display unit of claim 32, wherein the retractable rack comprises a front and rear horizontal beam, the ends of the horizontal beam being connected by a vertical beam.

34. The death care merchandise display unit of claim 33, wherein the slide mechanism consists of one member attached to the inner side of the wing wall panel and a second member attached to the vertical beam of the rack.

35. The death care merchandise display unit of claim 31, further comprising at least one retractable drawer for storage of adornment materials.

36. The death care merchandise display unit of claim 32, further comprising at least one retractable drawer for storage of adornment materials.

37. The death care merchandise display unit of claim 31, further comprising a decorative wall panel mounted on at least one of the wing wall panels.

38. The death care merchandise display unit of claim 31, further comprising a cornice.

39. The death care merchandise display unit of claim 32, wherein the second decedent confinement chamber is a casket.

40. The death care merchandise display unit of claim 32, further comprising at least one retractable drawer above said second decedent confinement chamber for storage of adornment materials.

41. The death care merchandise display unit of claim 28, further comprising at least one retractable drawer in close proximity to the decedent confinement chamber for storage of adornment materials.

42. The death care merchandise display unit of claim 32, further comprising a cornice.

43. The death care merchandise display unit of claim 31, wherein the decedent confinement chamber is a sectional of a casket or burial vault.

44. The death care merchandise display unit of claim 32, wherein the decedent confinement chamber is a sectional of a casket.

45. The death care merchandise display unit of claim 44, wherein the second decedent confinement chamber is a casket.

46. A death care merchandise display unit comprising:

two vertical, parallel, spaced wing wall panels having vertical rear and front edges;

vertical back wall having lateral edges removably secured to said rear edges of said wing wall panels, the back wall supporting said wing wall panels and maintaining them in a vertical direction; and at least one sectional decedent confinement chamber selected from the group consisting of caskets, coffins and burial vaults attached to at least one of the wing wall or back wall panels extending therefrom at an angle greater than 90° relative to the wall panel.

47. The death care merchandise display unit of claim 46, wherein the sectional decedent confinement chamber is a section of a casket.

48. The death care merchandise display unit of claim 46, further comprising a cornice.

49. The death care merchandise display unit of claim 46, further comprising at least one retractable drawer in close proximity to the sectional decedent confinement chamber for storage of adornment materials.

50. A modular death care merchandise display unit having as a first display unit:

two vertical, parallel, spaced wing wall panels;

a vertical back wall having lateral edges secured to the rear edges of said wing wall panels; and a rack or display shelving positioned between the two vertical spaced wing wall panels;

said wing wall panels further having means for securing, when desired, vertical, parallel spaced wing wall panels of a second display unit on top of the wing wall panels of the first display unit; and said back wall panel further having means for securing, when desired, a vertical back wall of a second display unit.

51. The modular death care merchandise display unit of claim 50, further comprising a second display unit on top of the first display unit, said second display unit defined by two vertical, parallel spaced wing wall panels having vertical rear and front edges and a vertical back wall panel having lateral edges secured to said rear edges of the wing wall panels of the second display unit.

52. The modular death care merchandise display unit of claim 51, wherein the wing wall panels of the second display unit contain means for securing, when desired, vertical, parallel spaced wing wall panels of a third display unit on top of the wing wall panels of the second display unit; and wherein said back wall panel of said second display unit further contains means for securing, when desired, a vertical back wall of a third display unit.

53. The modular death care merchandise display unit of claim 50, wherein the rack between the two wing panels is retractable.

54. The modular death care merchandise display unit of claim 53, wherein the retractable rack is comprised of a front and rear horizontal beam, the ends of the horizontal beams connected by vertical beams.

55. The modular death care merchandise display unit of claim 54, wherein the retractable rack is moveable by means of a slide mechanism; one member of the slide mechanism being attached to the inner side of the wing wall panel and the second member being attached to the vertical beam of the rack.

56. The modular death care merchandise display unit of claim 51, further comprising a stationary rack between the wing wall panels of the second display unit.

57. The modular death care merchandise display unit of claim 52, further comprising a stationary rack between the wing wall panels of the second display unit.

58. The modular death care merchandise display unit of claim 50, further comprising at least one retractable drawer above said rack for storage of adornment materials.

59. The modular death care merchandise display unit of claim 56, further comprising at least one retractable drawer in close proximity to the stationary rack for storage of adornment materials.

60. The modular death care merchandise display unit of claim 52, further comprising a cornice.

61. A death care merchandise display unit comprising:

two vertical, parallel, spaced wing wall panels and a back wall having lateral edges secured to the rear edges of the wing wall panels, said back wall supporting said wing wall panels, and maintaining them in a vertical direction;

a cornice unit comprising a mounting member cantilevered from the back wall, said mounting member comprising two vertical panels and a horizontal beam secured to the vertical panels, said horizontal beam extending at least fifty percent of the distance of the vertical back wall; at least one illumination means affixed on the inside wall of at least one of the vertical panels; the vertical panels containing said illumination means further containing a recessed path in its top for receiving the electrical wiring of said illumination means and an aperture extending from the connection point of the illumination means to the top of said recessed path above the illumination means.

62. The death care merchandise display unit of claim 61, further comprising at least one sectional of a decedent confinement chamber selected from the group consisting of caskets, burial vaults, and coffins, said sectional attached to either the back wall or wing wall panel.

63. The death care merchandise display unit of claim 62, wherein the decedent confinement chamber is a casket.

* * * * *